US005160818A

United States Patent [19]

Dufournet et al.

[11] Patent Number: 5,160,818

[45] Date of Patent: Nov. 3, 1992

[54] SERIES-ARC HIGH TENSION CIRCUIT-BREAKER

[75] Inventors: Denis Dufournet, Bron; Michel Perret, Bourgoin-Jallieu, both of France

[73] Assignee: GEC Alsthom SA, Paris, France

[21] Appl. No.: 688,797

[22] Filed: Apr. 22, 1991

[30] Foreign Application Priority Data

Apr. 26, 1990 [FR] France ..... 90 05326

[51] Int. Cl.[5] ..... H01H 33/88

[52] U.S. Cl. ..... 200/148 A; 200/148 R

[58] Field of Search ..... 200/148 R, 148 A, 148 B, 200/150 G, 148 BV

[56] References Cited

U.S. PATENT DOCUMENTS 3,985,988 10/1976 Korner et al. ..... 200/148 R
4,880,946 11/1989 Thuries et al. ..... 200/148 A
4,945,198 7/1990 Thuries et al. ..... 200/148 A
4,983,791 1/1991 Thuries et al. ..... 200/148 A
4,996,399 2/1991 Thuries et al. ..... 200/148 A
5,001,314 3/1991 Thuries et al. ..... 200/148 B

FOREIGN PATENT DOCUMENTS 0302390 2/1989 European Pat. Off. .
0334181 9/1989 European Pat. Off. .
2349263 4/1975 Fed. Rep. of Germany .
2610763 8/1988 France .

*Primary Examiner*—J. R. Scott
*Attorney, Agent, or Firm*—Sughrue, Mion, Zinn, Macpeak & Seas

[57] ABSTRACT

A dielectric gas arc-blasting high tension circuit-breaker of the type including secondary arcing contacts enables pressure upon secondary arcing to be developed inside a secondary volume defined by two concentric tubes and a pair of axially spaced pistons carried by respective tubes to facilitate circuit-breaker opening. All of the electrical contacts of the circuit-breaker are disposed outside of the secondary volume.

5 Claims, 2 Drawing Sheets

FIG.

SERIES-ARC HIGH TENSION CIRCUIT-BREAKER

The present invention relates to a dielectric gas blast circuit-breaker of the type including extra contacts which, on opening, generate a secondary arc in series with the main arc, the energy produced by this secondary arc being used to drive the apparatus.

BACKGROUND OF THE INVENTION

A circuit-breaker of this type is described in French patent No. 2610763, for example.

An aim of the present invention is to provide a circuit-breaker of the above-mentioned type which is easy to implement, in particular as regards the portion which generates the secondary arc.

Another aim of the invention is to provide a circuit-breaker which has no sliding contacts in the region of the secondary arc. This region is polluted by decomposition products from the dielectric gas and this may degrade the quality of the sliding contacts.

Another aim of the invention is to provide a circuit-breaker having no insulating piston, since such a piston is expensive to implement, and is subject to wear and so requires replacing frequently.

Another aim of the invention is to provide a circuit-breaker having lightweight moving equipment, so that its operation only requires a small amount of drive energy.

SUMMARY OF THE INVENTION

The invention provides a high tension circuit-breaker containing dielectric gas under pressure and including at least one interrupting chamber per phase. Each interrupting chamber comprising an insulating case filled with said gas, and containing the following:

A fixed assembly comprising a fixed main contact and a fixed arcing contact which are electrically connected to a first terminal;

A moving assembly comprises a drive member which is integral with a part formed by a first tube constituting the moving arcing contact, and with a second tube which is coaxial with said first tube and which has a first end constituting the moving permanent contact and carrying a blast nozzle, said first and second tubes delimit a blast, first volume closed by a perforated annulus interconnecting said tubes and by a fixed blast piston.

Two secondary arcing contacts are disposed in a second volume situated on the opposite side of the blast piston from the blast volume.

The blast piston is supported by a third metal tube which is coaxial to the first tube and which co-operates therewith and with a second piston which is an integral part of the first tube to delimit the second volume. The third tube is fixed by an insulating tubular portion to a fourth tube which is electrically connected to a second terminal of the circuit-breaker. The second tube has a second end in electrical contact both with the outside of said third tube and with the fingers electrically connected to said fourth tube. One contact of the secondary arcing contacts is fixed to said third tube the other contact being fixed to said fourth tube. Said secondary arcing contacts make contact with a tube which is integral with the moving assembly and which comprises an insulting tubular portion and a metal portion. The respective positions and lengths of these two tubular portions are chosen so that in the engaged position, at least one contact of the secondary arcing contacts makes contact with the insulating portion, and so that during opening, the two secondary arcing contacts initially make contact simultaneously with the metal portion, and later at least one of said secondary arcing contacts leaves this metal portion.

In a particular embodiment, the second end of said second tube is formed into a collar having an external cylindrical portion against which said fingers bear and having an internal cylindrical portion fitted with sliding contacts which co-operate with said fourth tube.

The blast piston is fitted with a first calibrated non-return valve which allows the gas to pass from the inside to the outside of the blast volume.

The blast piston is also fitted with a non-return valve allowing the gas to pass only from the outside to the inside of the blast volume.

The second piston is fitted with a third non-return valve allowing the gas to pass only from the outside to the inside of the second volume.

BRIEF DESCRIPTION OF THE DRAWINGS

An embodiment of the invention is described by way of example with reference to the accompanying drawings, in which.

DETAILED DESCRIPTION

Figure 1:
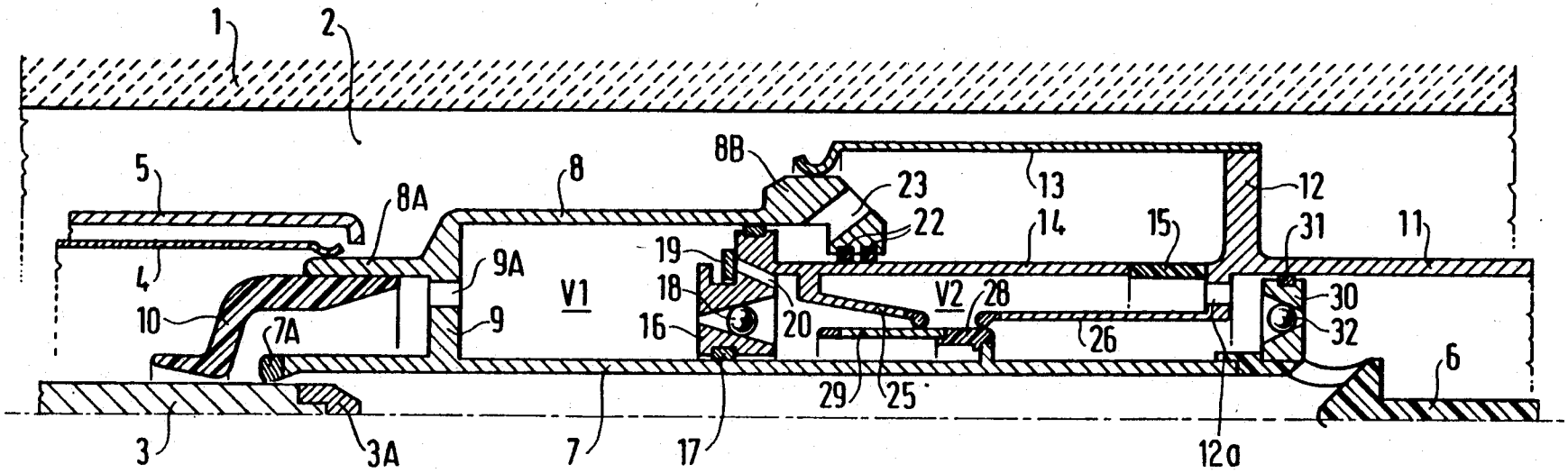
FIG. 1 is a fragmentary diagrammatic view of an axial half-section through an interrupting chamber of a circuit-breaker of the invention, shown in the engaged position.

There follows a description of an interrupting chamber; it should naturally be understood that a high tension circuit-breaker may include a plurality of interrupting chambers of the type described below, for each phase.

In the figures, the reference 1 designates an insulating case, preferably made of porcelain, delimiting a chamber 2 filled with a gas having good dielectric properties, e.g. sulfur hexafluoride under a pressure of a few bars.

The fixed contact assembly includes a fixed arcing contact 3 constituted by a metal tube whose end 3A is made of a material that withstands the effects of arcing, e.g. a tungsten-based alloy. The fixed contact assembly also includes a fixed main contact 4 constituted by fingers protected by an anti-corona cap 5. Both the fixed arcing contact and the fixed main contact are electrically connected to a first terminal which is not shown.

The moving equipment includes a drive part 6, constituted by a tube which is made of an insulating material and which passes through the wall of the casing forming chamber 2 in a gastight manner and which is connected to a mechanism that is not shown.

Connected to the fixed part is a metal assembly comprising two metal tubes 7 and 8 which are coaxial and interconnected by a metal annulus 9. These tubes and this annulus are preferably machined as a single piece.

Tube 7 constitutes the movable arcing contact. Its end 7A is made of a material that withstands the effects of arcing and co-operates with the contact 3-3A.

The first end 8A of tube 8 is small in diameter and has a blast nozzle 10 made of an insulating material.

The tubular portion 8A constitutes the movable main contact of the circuit-breaker and co-operates with the fingers 4 when the circuit-breaker is in the engaged position, as shown in FIG. 1.

A fixed metal tube 11, electrically connected to a second terminal (not shown) of the circuit-breaker, has an annulus 12 supporting metal fingers 13 which, when the circuit-breaker is in the engaged position, make electrical contact with an end 8B of the tube 8 in the form of a radially enlarged collar that is thicker than the tube. The contact is made via a portion of the external cylindrical surface of the collar 8B.

Here again, it should be understood that the collar 8B preferably forms one piece with the tubes 7 and 8 and the annulus 9.

A fixed metal tube 14, which is preferably similar in diameter to the tube 11 and which is fixed thereto by a tubular portion 15 made of an insulating material, is mechanically connected to a metal piston which supports tubes 7 and 8 which slide thereon to vary the size of an annular volume V1 delimited by the tubes 7 and 8, and by the annulus 9. It can now be understood that the tubes 14 and 15, the contacts 13 and the piston 16 are fixed components of the circuit-breaker since they are all fixed to the fixed tube 11.

The piston 16 includes sealing rings 17. It is fitted with a calibrated first, non-return valve 18 for limiting the pressure inside the volume V1. This valve is used when interrupting low currents, as is explained further on. The piston also includes a second, non-return valve 19 which allows gas to pass only from the outside to the inside of the volume V1. This valve is merely a washer overlying holes 20 through the piston.

In order to allow the gas to pass through the nozzle 10, the annulus 9 is perforated with holes 9A.

Sliding electrical contacts 22 on an internal cylindrical surface of the collar 8B bear against the tube 14. The collar 8B is perforated with holes 23 in order to lighten it and facilitate gas circulation.

On either side of the insulating portion 15, each of tubes 14 and 11 carries a respective one of the two components 25 and 26 of the secondary arcing contact. These components are constituted by tube portions whose ends are made of an alloy that withstands the effects of arcing.

The contacts 25 and 26 co-operate with a switching tube which is fixed to tube 7 and thus moves therewith, and which comprises an insulating portion 28 and a metal portion 29 whose end is made of a material that withstands the effects of arcing.

The circuit-breaker further includes a metal piston 30 which an integral part of the drive tube 6 and is fitted with a sealing ring 31 and a third non-return valve 32 allowing gas to pass only from the outside to the inside of the volume V2 which is defined by the concentric tubes 7 and 14, and the pistons 16 and 30.

The circuit-breaker operates in the following manner:

In the engaged position (FIG. 1), the current flows through the fingers 4, the tube 8A-8-8B, the fingers 13, the annulus 12 and the tube 11.

Interrupting high currents

This concerns short-circuit currents.

The drive tube 6 is actuated and moves towards the right in the figure.

Figure 2:
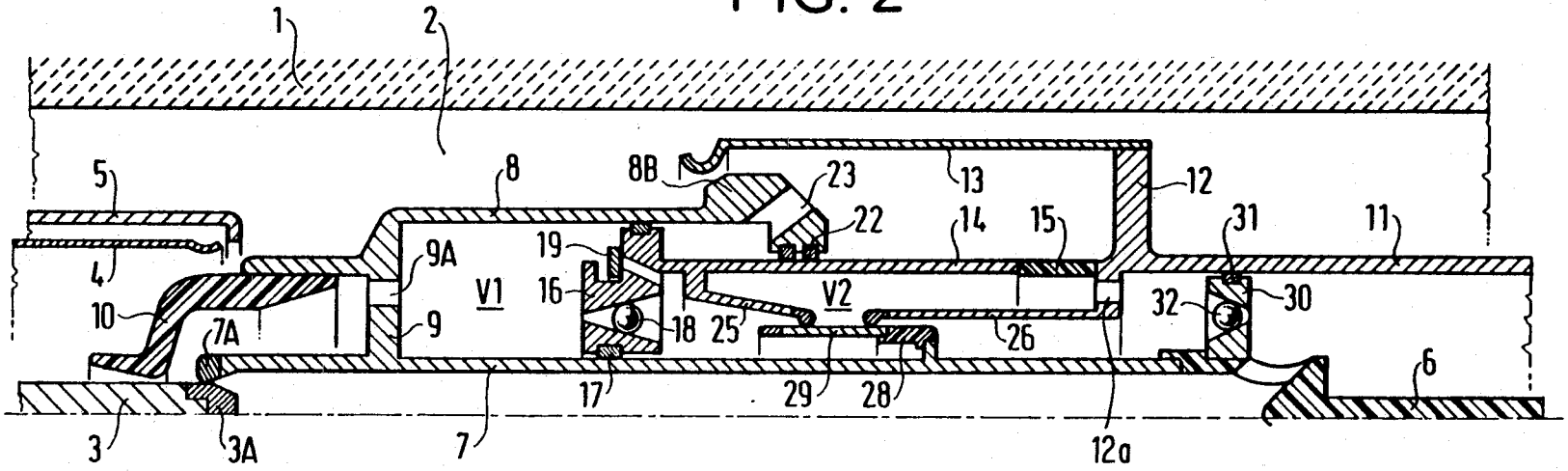
FIG. 2 is a fragmentary diagrammatic view of an axial half-section of the same chamber, shown at the start of disengagement.

The main contacts 4 and 8A separate (FIG. 2) and the current is switched to the arcing contacts 3 and 7A. The fingers 13 leave the collar 8A, but the secondary arcing contacts 25 and 26 come into contact with the metal portion 29 of the switching tube. Thus, the current takes the following path: the tube 3, the tube 7, the annulus 9, the tube 8, the collar 8B, the contacts 22, the tube 14, the contact 25, the tube 29, the contact 26, and the tube 11.

Figure 3:
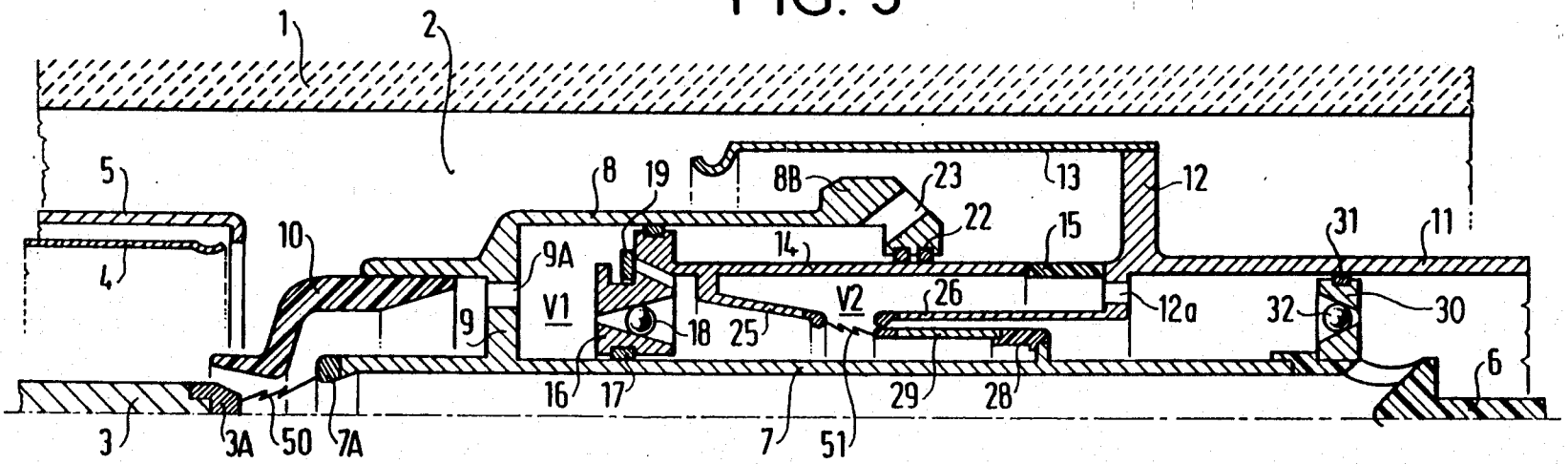
FIG. 3 is a fragmentary diagrammatic view of the same chamber, shown at a later phase in the disengagement.

When the arcing contacts 3A–7A separate (FIG. 3), a primary arc 50 is struck between them. At about the same time, the contacts 25 and 29 separate, and a secondary arc 51 is struck in the volume V2. This secondary arc heats the gas in volume V2 thereby producing an increase in pressure which, both assists in providing the opening drive by applying energy to the drive tube 6 by acting on the piston 30 via hub 12*a*, and also contributes to blasting the primary arc by locking the limiting valve 18, which means that all the gas in volume V1 is blasted.

Interrupting low currents

This concerns currents not greater than the nominal current of the installation.

The operation is similar to that described above, but this time, the current to be interrupted is low, so that the secondary arc 51 provides insufficient energy to close the valve 18 against the prevailing pressure in volume V1. The pressure in volume V1 is limited by the calibrated valve 18.

There is no pressure drop in volume V2 since the valve 32 opens and fills volume V2 with gas.

Closing the circuit-breaker

Closing the circuit-breaker is caused by the drive tube 6 being displaced towards the left in the figures. The valves 19 open during this operation, so that pressure drops or rises do not have to be overcome; the closing operation likewise requires only a small amount of drive energy.

The circuit-breaker of the invention has a structure which is simple and therefore cheap, and which is compact and therefore robust and rigid, with no electrical contacts in the arcing regions, thus requiring less maintenance.

The invention applies to implementing a high tension circuit-breaker.

We claim:

1. A high tension circuit-breaker containing dielectric gas under pressure and including, at least one interrupting chamber per phase, each interrupting chamber comprising an insulating case filled with said gas, and containing the following:

a fixed assembly comprising a fixed main contact and a fixed arcing contact which are electrically connected to a first terminal;

a moving assembly comprising a drive member which is integral with a first tube constituting a moving primary arcing contact, and with a second tube which is coaxial with said first tube and which has a first end constituting a moving main contact and carrying a blast nozzle, said first and second tubes partially delimiting a blast, first volume closed by a perforated annulus interconnecting said tubes and by a first, fixed blast piston; and two secondary arcing contacts disposed in a second volume situated on the opposite side of the blast piston from said blast first volume; and wherein said first, fixed blast piston is supported by a third metal tube which is coaxial to the first tube and which co-operates therewith and with a second piston which is an integral part of said first tube to delimit said second volume, said third tube being fixed by an insulating tubular portion to a fourth tube which is electrically connected to a second terminal of the circuit-breaker, said second tube having a second end in electrical contact both with the outside of said third tube and with the fingers electrically connected to said fourth tube, one of said secondary arcing contacts being fixed to said third tube and another of said secondary arcing contacts being fixed to said fourth tube, said secondary arcing contacts making contact with a fifth tube integral with the moving assembly and comprising an insulating tubular portion and a metal tubular portion, the respective positions and lengths of said two tubular portions being chosen so that in the engaged position, at least one of the secondary arcing contacts makes contact with the insulating portion, such that during opening, said two secondary arcing contacts initially make contact simultaneously with the metal portion, and later at least one of said secondary arcing contacts leaves said metal portion.

2. A circuit-breaker according to claim 1, wherein the second end of said second tube includes a collar having an external cylindrical portion against which said fingers bear and having an internal cylindrical portion fitted with sliding contacts which slidably engage said fourth tube.

3. A circuit-breaker according to claim 1, wherein the first, fixed blast piston is fitted with a first, calibrated non-return valve which allows gas to pass from the inside to the outside of the first, blast volume.

4. A circuit-breaker according to claim 3, wherein said first, fixed blast piston is further fitted with a second, non-return valve allowing gas to pass only from the outside to the inside of the first, blast volume.

5. A circuit-breaker according to claim 1, wherein the second piston is fitted with a non-return valve allowing gas to pass only from the outside to the inside of the second volume.

* * * * *